US005467620A

United States Patent [19]

Byrd, Jr.

[11] Patent Number: 5,467,620

[45] Date of Patent: * Nov. 21, 1995

[54] U-LOCK WITH STRENGTH ENHANCING HEADER EXTENSIONS

[76] Inventor: Richard H. Byrd, Jr., 949 Steiner St., San Francisco, Calif. 94117

[ * ] Notice: The portion of the term of this patent subsequent to Aug. 2, 2011, has been disclaimed.

[21] Appl. No.: 224,162

[22] Filed: Apr. 7, 1994

Related U.S. Application Data

[63] Continuation of Ser. No. 942,578, Sep. 9, 1992, Pat. No. 5,333,476.

[51] Int. Cl.[6] ..... E05B 67/24

[52] U.S. Cl. ..... 70/38 A; 70/39; 70/52; 70/56; 70/227; 70/233; 70/417

[58] Field of Search ..... 70/39, 38 A, 52, 70/233, 54–56, 38 R, 38 B, 38 C, 26, 227, 417

[56] References Cited

U.S. PATENT DOCUMENTS

| | | | |
|---|---|---|---|
| 53,096 | 3/1866 | Ascherfeld | 70/55 |
| 415,046 | 11/1889 | Logan | 70/52 |
| 885,253 | 4/1908 | Hummel | 70/52 |
| 899,268 | 9/1908 | Soley | 70/53 |
| 980,798 | 1/1911 | Krajdocha | 70/26 |
| 1,560,251 | 11/1925 | De Rouville et al. | 70/39 |
| 1,635,711 | 7/1927 | Fraim | 70/39 |
| 1,755,521 | 4/1930 | Smith | 70/38 A |
| 2,048,571 | 7/1936 | Slaymaker | 70/52 |
| 2,541,638 | 2/1951 | Clevett | 70/39 |
| 3,453,846 | 7/1969 | Owen et al. | 70/54 |
| 3,783,657 | 1/1974 | Foote | 70/52 |
| 3,805,564 | 4/1974 | Velardo | 70/18 |
| 4,085,600 | 4/1978 | Bindari | 70/39 |
| 4,141,232 | 2/1979 | Kelly | 70/54 |
| 4,226,100 | 10/1980 | Hampton et al. | 70/51 |
| 4,436,232 | 3/1984 | Zane et al. | 224/39 |
| 4,773,239 | 9/1988 | Lowe et al. | 70/39 X |
| 4,781,043 | 11/1988 | Loeffler | 70/54 |
| 4,888,967 | 12/1989 | Kuo | 70/52 |
| 4,905,486 | 3/1990 | Appelbaum | 70/54 |
| 4,972,689 | 11/1990 | Anderson | 70/56 |
| 5,181,403 | 1/1993 | Lii | 70/38 C |

FOREIGN PATENT DOCUMENTS

| | | | |
|---|---|---|---|
| 163250 | 6/1949 | Austria | 70/26 |
| 511817 | 1/1920 | France | 70/26 |
| 356951 | 8/1922 | Germany | 70/39 |
| 359098 | 9/1922 | Germany | 70/38 R |
| 388160 | 1/1924 | Germany | 70/38 C |
| 413366 | 4/1946 | Italy | 70/55 |
| 8264 | of 1901 | United Kingdom | 70/54 |
| 2157756 | 10/1985 | United Kingdom | 70/233 |

*Primary Examiner*—Lloyd A. Gall
*Attorney, Agent, or Firm*—Haverstock & Associates

[57] ABSTRACT

A U-lock includes a detachable header with extensions that fit around the arms of the U-bar and extend along the length of those arms to provide strength to the U-lock. The header can be used so that its base is locked at the end of the arms of the U-shaped bar or it can be inverted when locking smaller objects so that its base is locked along the lengths of the arms taking up some of the gap between the locked object and the base of the header. The header is locked to the arms of the U-shaped bar by a locking mechanism which secures the header to the arms of the U-shaped bar in four different places, two on each arm. The U-lock and header with extensions can also be used in combination with security spacers for further security.

15 Claims, 2 Drawing Sheets

U-LOCK WITH STRENGTH ENHANCING HEADER EXTENSIONS

This is a Continuation of application Ser. No. 07/942,578, filed Sep. 9, 1992, U.S. Pat. No. 5,333,476.

FIELD OF THE INVENTION

This invention relates to the field of locks. More specifically, this invention relates to the field of U-locks with detachable headers which are commonly used for bicycles.

BACKGROUND OF THE INVENTION

U-locks are commonly used for locking a bicycle to prevent theft of the bicycle. Ordinarily, a rider will lock the bicycle frame and at least one wheel to a post to secure the bicycle. Often, an experienced rider will remove the front wheel of the bicycle in order to lock it as well.

A U-lock principally includes a U-shaped bar with two substantially straight and parallel arms coupled to one another by a curved bow and a removable header. In the prior art the header has been a bar or tube which includes a passive hole and a locking hole each spaced about one inch from the opposite ends of the header. A rotating lock is fitted in the end of the header for securing the header to the U-shaped bar.

The U-shaped bar is made of metal bar stock formed into a U-shape with the arms of the bar in the range of four to six inches apart. A first arm includes a 90° bend which is positioned about one inch from its end forming a short bar section. The second arm is formed to properly mate with the rotating lock of the header. Prior art U-locks are also designed to have two substantially straight parallel arms which are jointly locked within the header.

To lock the U-lock, the shone bar section is placed into the passive hole and the U-bar and the header are rotated about the 90° bend relative to one another so that the entire short bar section is pushed inside the header and the second end of the U-bar bar enters the locking hole. The rotating lock is then activated by a key to prevent the second end of the lock from being removed from the header thereby securely holding the lock closed. The straight arm U-locks are locked by inserting the locks into the header and activating the locking mechanism.

To lock a bicycle to a post or other object, the ends of the U-shaped bar are passed around the post and a portion of the frame and one tire (or both) of a bicycle. It is impossible to predict the thickness of the post to which a rider may desire to lock a bicycle. Further, bicycles are available with a variety of sizes of frame tubes, frame tube spacing, tires and wheels. U-locks are also used to lock motorcycles, boats, jet skis and many other objects.

It is possible and likely that the U-shaped bar of such a lock is longer than the combined dimension of the bicycle, tire and post. This excess length may be long enough to allow an unscrupulous person to insert an automobile jack or some other device between the arms of the U-shaped bar. Because an automobile jack is designed to lift the weight of an automobile, it is sufficiently strong to cause the U-lock to fail simply by forcing the lock open. A practiced thief can pre-size the jack to the proper spacing of the distance between the arms of the U-lock so that the jack need only be expanded to break the lock, allowing the thief to complete the theft in approximately twenty seconds.

To strengthen the U-lock and provide additional security, the prior art has used a security spacer which fits along the arms of the U-lock and blocks the space that can be left between the object being locked and the header. This type of security spacer is described in the U.S. patent application Ser. No. 07/755,546 by Richard H. Byrd filed on Sep. 5, 1991. This security spacer substantially fills the gap between the object being locked and the header to prevent the insertion of a jack and is held in place by the header.

while these security spacers do strengthen the U-lock and provide additional security, it is possible that there may still be enough space for an unscrupulous person to fit an automobile jack between the arms of the U-lock and cause it to fail. A U-lock in combination with one or more security spacers will withstand more pressure than a U-lock without a security spacer.

A bicycle thief will also fit the end of a pipe over the end of the header of the U-lock, putting pressure on the other end of the pipe in order to cause the lock to fail and the header to pop off. What is needed is a U-lock with a stronger, better designed header which will withstand greater pressure applied by an automobile jack and whose header end will not receive the end of a pipe.

SUMMARY OF THE INVENTION

A U-lock includes a detachable header with extensions that fit around the arms of the U-bar and extend along the length of those arms to provide strength to the U-lock. The header can be used so that its base is locked at the end of the arms of the U-shaped bar or it can be inverted when locking smaller objects so that its base is locked along the lengths of the arms taking up some of the gap between the locked object and the base of the header. The header is locked to the arms of the U-shaped bar by a locking mechanism which secures the header to the arms of the U-shaped bar in four different places, two on each arm. The U-lock and header with extensions can also be used in combination with security spacers for further security.

DETAILED DESCRIPTION OF THE PREFERRED EMBODIMENT

Figure 1:
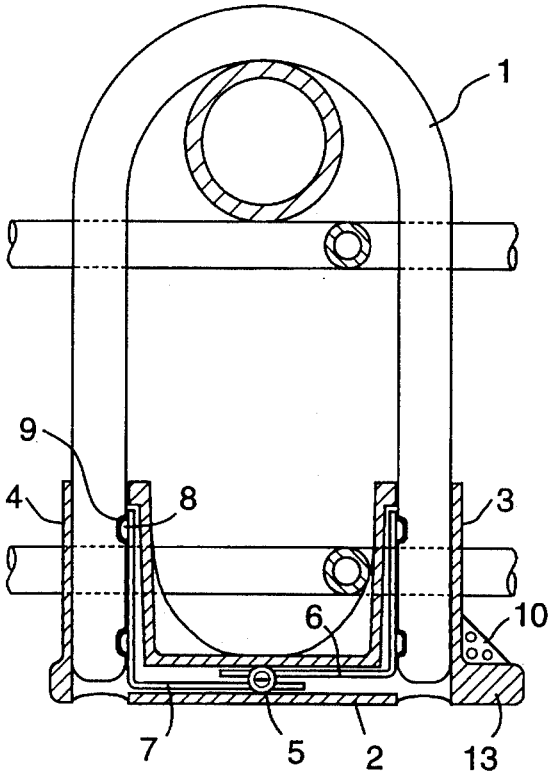
FIG. 1 illustrates the present invention locking a large object such as a motorcycle wheel.

FIG. 1 illustrates the present invention used to lock an object such as a motorcycle wheel to a post. The U-shaped bar 1 fits around the post and between the spokes of the wheel. The header 2 includes two arm extensions 3, 4 which fit around the arms of the U-shaped bar 1 and slide up towards the post until the header is in a locking position. The length 22 of the two arm extentions 3, 4 should be at least twice as long as the smallest dimension 20 of the header 2 that is parallel to the arms of the U-shaped bar when it is locked to the header. These two arm extensions 3, 4 add strength to the parallel arms of the U-shaped bar or shackle 1, thereby resisting breaking of the present invention under application of outward forces to the two arms of the U-shaped bar of shackle 1, such as those applied by a car jack. A key is then placed into a key hole 5 and turned, forcing the locking mechanisms 6, 7 to slide out, thus locking the header to the U-shaped bar. When in the locked position the locking bars 6, 7 secure the protrusions 8 into the receiving cutouts 9 in the U-shaped bar 1 thereby locking the header 2 to the U-shaped bar 1. The header 2 also can be equipped with a pry pipe block 10 which prevents a pipe from being slipped over the end of the header. The pry pipe block 10 is a piece of metal welded to the outside of the header 2 as shown in FIG. 1. The pry pipe block 10 can have multiple holes in it for minimizing the weight of the U-lock. In the present invention it is not necessary that a pry pipe block 10 be included.

Figure 2:
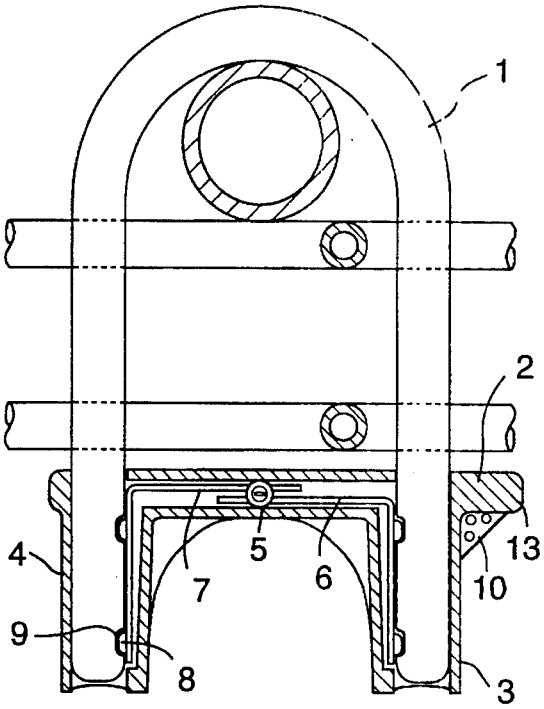
FIG. 2 illustrates the present invention locking a smaller object such as a bicycle wheel with the header inverted.

FIG. 2 illustrates the present invention used to lock a smaller object such as a bicycle wheel to a post. The header 2 can be inverted such that the header is slid on the arms of the U-shaped bar 1 first and the extension arms 3, 4 of the header are then slid on the arms of the U-shaped bar 1. This arrangement, with the header closer to the object being locked, provides a stronger relationship between the header 2 and the U-shaped bar 1 thus making it more difficult for a thief to cause the U-lock to fail. The locking mechanism, including the key-hole 5 and the locking bars 6, 7 works the same way as in FIG. 1, a key is inserted into the key-hole 5 and turned causing the locking bars to slide out and forcing the protrusions 8 into the cutouts 9 of the U-shaped bar.

Figure 3:
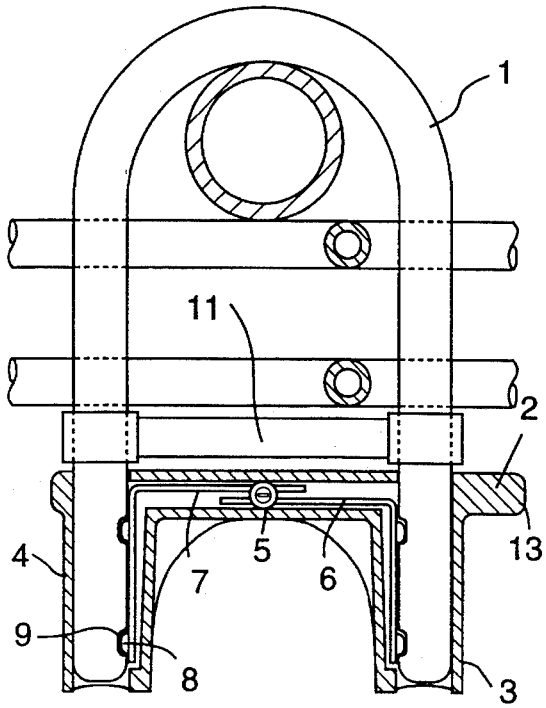
FIG. 3 illustrates the present invention locking a smaller object such as a bicycle wheel with the header inverted and a security spacer used between the wheel and the header.
Figure 5:
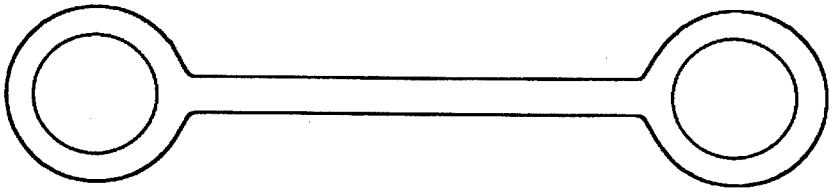
FIG. 5 illustrates a spacer having apertured ends, each end formed as an oval cylinder.

FIG. 3 illustrates the present invention, with the header 2 in the inverted position and a security spacer 11 used to block a portion of the space between the object being locked and the header. The security spacer 11 is slid onto the arms of the U-shaped bar 1 before the header 2 with the extensions 3, 4 is slid on and locked. The security spacer 11 fills the gap between the header 2 and the object being locked in order to prevent the insertion of an automobile jack between the arms of the U-shaped bar 1. Preferably, the security spacer is comprised of circular ends for sliding over the ends of the U-shaped bar 1. In an alternate embodiment, the security spacer has ends formed as oval cylinders, as illustrated in FIG. 5.

Experimental results show that the strength of the U-lock is enhanced by the insertion of the security spacers 11. In fact, applying a jack to a U-lock between two security spacers 11 has caused the jack to fail rather than the U-lock. Thus, a theft may be prevented in a situation where a security spacer 11 is used but a sufficiently large gap remains to allow the insertion of a jack. The extensions 3, 4 of the header 2 also serve to strengthen the U-lock and thus make failure of the lock harder to cause. The extensions 3, 4 provide strength to the arms of the U-shaped bar 1 and aid in preventing the failure of the U-lock due to the insertion of an automobile jack or some other device which might be used to try to spread the arms of the U-shaped bar apart.

Figure 4:
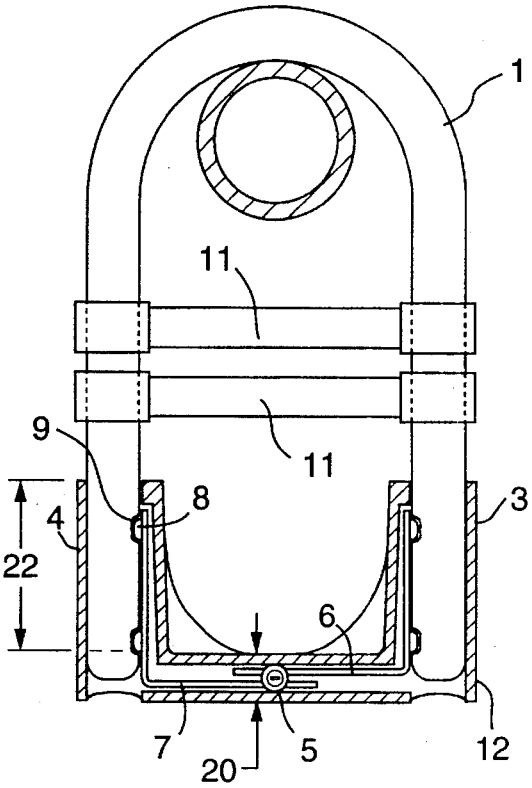
FIG. 4 illustrates the present invention with an alternate header which has square ends and its use with two security spacers.
Figure 6:
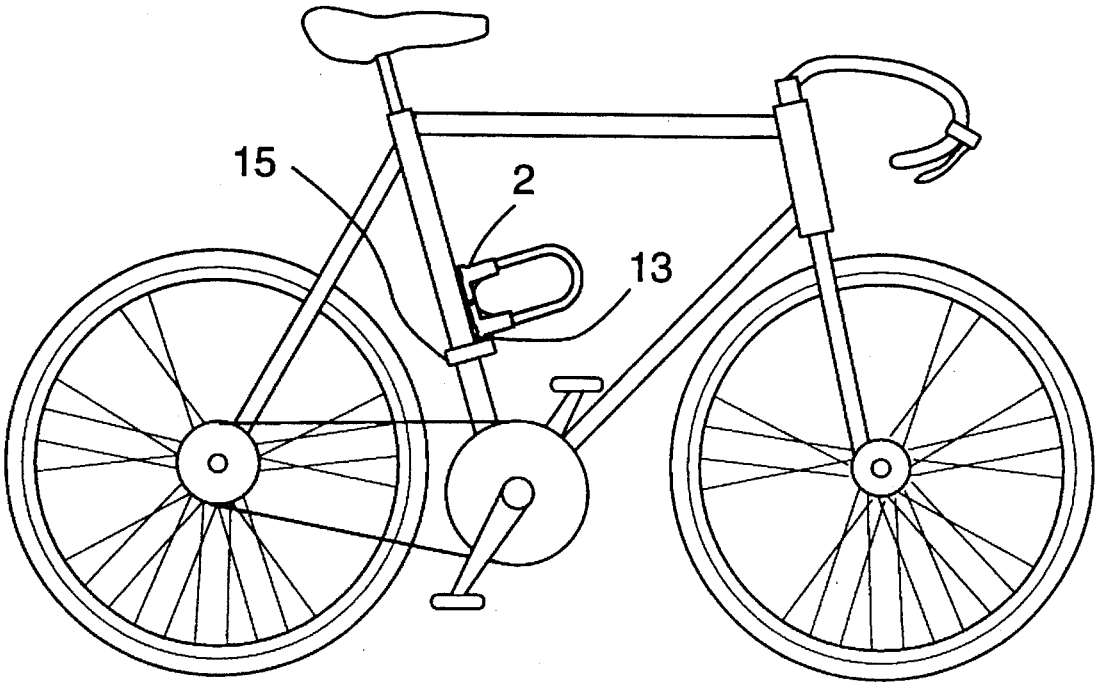
FIG. 6 illustrates the use of the present invention with a mounting harness on a bicycle.

FIG. 4 illustrates an alternate embodiment of the present invention which has a square header 12, without protrusions 13. In FIGS. 1 through 3 the header 2 is shown with protrusions 13 at each end. These protrusions are placed on the ends of the header so that it will fit into conventional mounting harnesses designed for conventional U-locks whose headers have no arm extensions 3, 4. These mounting harnesses are mounted on a bicycle frame and allow the rider to secure the U-lock to the bicycle frame while the bicycle is in use and the U-lock is not needed as illustrated in FIG. 6. These protrusions serve no purpose to the present invention other than to allow this U-lock to fit into those mounting harnesses thus allowing a user of the present invention to use a conventional mounting harness 15 to secure this U-lock to the frame of a bicycle. A pry pipe block is not necessary in the embodiment of the present invention illustrated in FIG. 4 because the header 12 does not have the protruding ends which are susceptible to the attaching of a pipe in order to pry the header away from the U-shaped bar.

The header 12 as shown in FIG. 4 has the same functional characteristics as the header 2 shown in FIGS. 1 through 3, except that its base is square and it does not have the protrusions. The locking mechanism of the header 12 shown in FIG. 4 works exactly the same way as the header 2. The header 12 can also be inverted and locked to the U-shaped bar. FIG. 4 also illustrates that more than one security spacer 11 can be used to fill the gap between the object being locked and the header.

We claim:

1. A locking apparatus for locking a first object to a second object, the apparatus comprising:

a. a U-shaped bar having two spaced apart, substantially straight and parallel arms with a space therebetween, the arms coupled together by a curved bow; and b. a detachable header having a base and two extension arms, the base having a first dimension parallel to the substantially straight and parallel arms and the extension arms having a second dimension parallel to the first dimension, wherein the second dimension is at least twice the first dimension, each extension arm having an enclosed, hollow, circular cylinder for receiving one of the substantially straight and parallel arms, either in a first regular position with the base of the header at the end of the parallel arms and the extension arms positioned between the base of the header and the curved bow or in a second inverted position with the base of the header secured between the ends of the parallel arms and the curved bow and the extension arms positioned between the base of the header and the ends of the parallel arms the header comprising a locking mechanism having a key receiving hole and two L-shaped bars for securing the header by locking to each of the substantially straight and parallel arms of the U-shaped bar.

2. The locking apparatus as claimed in claim 1 wherein the base of the header has protruding ends which extend perpendicular to the parallel arms of the U-shaped bar when the header is locked onto the U-shaped bar, one protruding end extending farther than the other, the protruding ends for attaching the locking apparatus to a mounting harness for carrying the locking apparatus when it is not in use.

3. The locking apparatus as claimed in claim 2 further comprising a pry pipe block coupled to the protruding end of the header base which extends the farthest for preventing the insertion of the header base protruding end into a pipe for unlawfully prying the header away from the U-shaped bar.

4. The locking apparatus as claimed in claim 3 further comprising a spacer means which may be slid onto the parallel arms of the U-shaped bar before the header is locked onto the U-shaped bar and can be simultaneously slidably positioned along both of the parallel arms anywhere between the header and the curved bow to fill a gap between an object being locked, the header and the parallel arms.

5. The locking apparatus as claimed in claim 4 wherein the spacer means comprises:

a. a pair of apertured members for receiving the parallel arms; and b. means for coupling the two apertured members to one another.

6. The locking apparatus as claimed in claim 5, wherein each of the apertured members is formed as an oval cylinder.

7. A U-lock apparatus comprising a U-shaped shackle with two substantially straight and parallel shackle arms coupled to one another by a curved bow wherein the substantially straight and parallel arms may be longer than an object being locked therein and a detachable header having a first dimension parallel to the shackle arms and the detachable header comprises a base and two extension arms wherein the extension arms have a second dimension parallel to the shackle arms and are at least twice the first dimension, the extension arms for accepting and sliding onto and surrounding the shackle arms when locking the shackle to the header for providing additional strength to the shackle arms for resisting breaking under application of lateral forces, and further wherein the header can be attached to the U-shaped shackle either in a first regular position with the base of the header at the end of the parallel shackle arms and the extension arms positioned between the base of the header and the curved bow or in a second inverted position with the base of the header secured between the ends of the parallel shackle arms and the curved bow and the extension arms positioned between the base of the header and the ends of the parallel shackle arms and the header comprises a locking mechanism and is locked to each arm of the U-shaped shackle in either the first regular position or in the second inverted position.

8. The U-lock apparatus as claimed in claim 7 wherein the base of the header has protruding ends which extend perpendicular to the parallel shackle arms of the U-shaped shackle when the header is locked onto the U-shaped shackle, one protruding end extending farther than the other, the protruding ends for attaching the U-lock apparatus to a mounting harness for carrying the U-lock apparatus when it is not in use.

9. The U-lock apparatus as claimed in claim 8 further comprising a pry pipe block coupled to the protruding end of the header base which extends the farthest for preventing the insertion of the header base protruding end into a pipe for unlawfully prying the header away from the U-shaped shackle.

10. A locking apparatus comprising:

a. a U-shaped bar having two spaced apart, substantially straight and parallel arms with a space therebetween and a curved bow coupling the two substantially straight and parallel arms to each other; and b. a detachable header having a base and two extension arms, the base having a first dimension parallel to the extension arms and the extension arms having a second dimension which is parallel to the substantially straight and parallel arms, wherein the second dimension is at least twice the first dimension, each extension arm having a self-enclosed cylinder for receiving one of the substantially straight and parallel arms the header comprising means for locking the header to the U-shaped bar, wherein the header can be attached to the U-shaped bar either in a first regular position with the base of the header at the end of the parallel arms and the extension arms positioned between the base of the header and the curved bow or in a second inverted position with the base of the header secured between the ends of the parallel arms and the curved bow and the extension arms positioned between the base of the header and the ends of the parallel shackle arms and the header is locked to each arm of the U-shaped shackle in either the first regular position or in the second inverted position.

11. The locking apparatus as claimed in claim 10 wherein the means for locking comprises:

a. a key receiver in the base of the header for allowing insertion of a key into the locking means;

b. a first L-shaped bar coupled to the key receiver on one leg of the bar and on the opposite leg of the bar having two protrusions extending away from the L-shaped bar, for sliding into cutouts in a parallel arm of the U-shaped bar, thereby securing the header to the U-shaped bar when the key is inserted into the key receiver and turned when either the header is attached to the U-shaped bar in the first regular position or in the second inverted position; and c. a second L-shaped bar coupled to the key receiver on one leg of the bar and on the opposite leg of the bar having two protrusions extending away from the L-shaped bar, for sliding into cutouts in a parallel arm of the U-shaped bar when either the header is attached to the U-shaped bar in the first regular position or in the second inverted position, thereby securing the header to the U-shaped bar, when the key is inserted into the key receiver and turned.

12. The locking apparatus as claimed in claim 11 wherein the base of the header has protruding ends which extend perpendicular to the parallel arms of the U-shaped bar when the header is locked onto the U-shaped bar, one protruding end extending farther than the other, the protruding ends for attaching the locking apparatus to a mounting harness for carrying the locking apparatus when it is not in use.

13. The locking apparatus as claimed in claim 12 further comprising a pry pipe block coupled to the protruding end of the header base which extends the farthest for preventing the insertion of the header base protruding end into a pipe for unlawfully prying the header away from the U-shaped bar.

14. The locking apparatus as claimed in claim 13 further comprising a spacer means which may be slid onto the parallel arms of the U-shaped bar before the header is locked onto the U-shaped bar and can be simultaneously positioned along both of the parallel arms to fill a gap between an object being locked, the header and the parallel arms.

15. The locking apparatus as claimed in claim 14 wherein the spacer means comprises:

a. a pair of apertured members for receiving the parallel arms; and b. means for coupling the two apertured members to one another.

* * * * *

UNITED STATES PATENT AND TRADEMARK OFFICE

CERTIFICATE OF CORRECTION

PATENT NO. : 5,467,620

DATED : Nov. 21, 1995

INVENTOR(S) : Byrd, Jr.

It is certified that error appears in the above-identified patent and that said Letters Patent is hereby corrected as shown below:

In column 1, line 37, please replace "shone" with --short--.

In column 2, line 10, please replace "while" with --While--.

Signed and Sealed this

Thirteenth Day of February, 1996

*Attest:*

Bruce Lehman

BRUCE LEHMAN

*Attesting Officer*

*Commissioner of Patents and Trademarks*